US007398969B2

(12) United States Patent
Elenes et al.

(10) Patent No.: US 7,398,969 B2
(45) Date of Patent: Jul. 15, 2008

(54) SYSTEM AND METHOD FOR SUPPLYING MEDIA TO A DEVICE

(75) Inventors: Luis Elenes, Camas, WA (US); Wesley Schalk, Camas, WA (US); Allan Olson, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 396 days.

(21) Appl. No.: 10/850,089

(22) Filed: May 20, 2004

(65) Prior Publication Data

US 2005/0258586 A1 Nov. 24, 2005

(51) Int. Cl.
*B65H 3/44* (2006.01)

(52) U.S. Cl. ..... 271/9.05; 271/9.06; 271/9.08; 271/9.11

(58) Field of Classification Search ..... 271/9.05, 271/9.06, 9.08, 9.11, 157, 158, 162, 164, 271/171; 347/104
See application file for complete search history.

(56) References Cited

U.S. PATENT DOCUMENTS 4,907,792 A * 3/1990 Washiashi et al. ..... 271/240
5,005,817 A * 4/1991 Ruch et al. ..... 271/9.08
5,044,620 A * 9/1991 Ruch et al. ..... 271/9.08
5,215,303 A * 6/1993 Yamada et al. ..... 271/240
6,056,285 A * 5/2000 Kikuta et al. ..... 271/118
6,619,656 B2 * 9/2003 Guddanti et al. ..... 271/171

FOREIGN PATENT DOCUMENTS

JP 05286591 A * 11/1993
JP 05286592 A * 11/1993
JP 05294473 A * 11/1993
JP 2000-177855 6/2000
JP 2003-285945 7/2003

OTHER PUBLICATIONS

Translation of Japan Office Action dated Jul. 11, 2006 wherein references JP 2003-285945 and JP 2000-177855 were cited. (3 pages).

* cited by examiner

*Primary Examiner*—David H Bollinger

(57) ABSTRACT

A system and method for supplying media to a device. The novel system includes a first tray for holding a first supply of media, a first mechanism including a shaft adapted to feed media from the first tray to the device when the shaft is rotated in a first direction, and a second mechanism for moving the first tray from a first position to a second position when the shaft is rotated in a second direction.

69 Claims, 7 Drawing Sheets

SYSTEM AND METHOD FOR SUPPLYING MEDIA TO A DEVICE

BACKGROUND

Media sheets are supplied to a typical printer by a supply tray (also known as an input tray), which holds a supply of the print media, such as paper, in a location that permits. paper to be brought into engagement with a feed mechanism of a printer. The feed mechanism contacts the top sheet of the media supply and advances that sheet into the printer. These feed mechanisms are often referred to as "pick and feed" rollers. From the pick and feed roller, the media sheet is moved into a print zone where an image or text is printed on the sheet.

Supply trays are normally adaptable to handle various sizes of paper. To this end, adjustable guides are built into the supply trays to ensure that whatever size paper is provided, it is advanced uniformly (i.e., without undesirable skewing) into the printer. With this type of input tray, the user is often required to remove the existing supply of paper from the tray before adding a different sized media. This slows the printing operation and requires physical interaction with the printer, which can be undesirable particularly for networked printers having users at remote locations.

Hence, a need remains in the art for a system or method for supplying small sized media to a printer that does not require physical interaction between the user and the printer.

DESCRIPTION OF EXAMPLE EMBODIMENTS

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

It is noted that for the purposes of this description the term "media" or "print media" is intended to include cut-sheet paper of any weight, photo-grade paper (or "photo media"), transparencies, envelopes, banners, rolled media, pre-printed documents to be scanned, and equivalents as would be recognized by those skilled in the art. Also, although the illustrative embodiments of the invention are adapted for a printer, the invention can be adapted for many other media processing devices such as copiers, facsimile machines, scanners, and the like without departing from the scope of the present teachings.

Figure 1A:
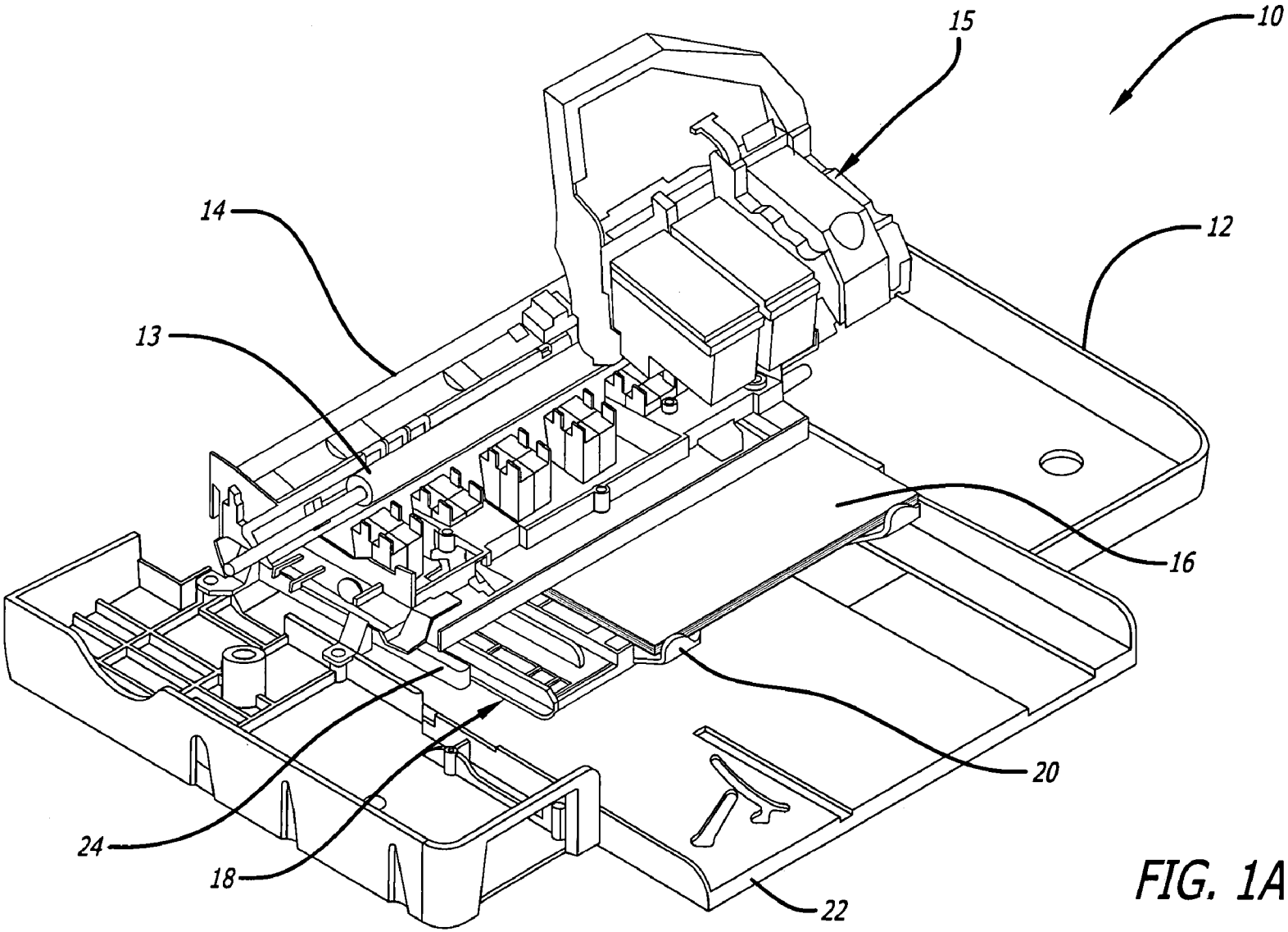
FIG. 1*a* is a perspective view of a portion of a printer adapted to use a media supply system implemented in accordance with an illustrative embodiment of the present invention.

FIG. 1*a* is a perspective view of a portion of a printer 10 that is adapted to use a media supply system designed in accordance with an illustrative embodiment of the present invention. Many of the printer components that are irrelevant to this description are omitted from the figure for clarity of illustration.

The printer 10 includes a chassis or base 12 and a platen 14, which is the stationary internal structure of the printer 10 that holds the many parts of the printer 10, including a feed mechanism (the feed shaft 13 of the feed mechanism is shown in FIG. 1*a*) for inputting media into the printer 10 and a print mechanism 15 for forming an image on a media sheet. Media 16 is supplied to the feed mechanism by a novel media supply system 18. The media supply system 18 includes a first tray 20 for holding a first supply of media 16 and a drive mechanism (not visible in FIG. 1*a*) for automatically moving the tray 20 from a first position to a second position. The first position, or load position, is located where a user can easily load media 16 into the tray 20, while the second position, or pick position, is located where the feed mechanism can pick media 16 from the tray 20 and feed it to the print mechanism 15. In FIG. 1*a*, the tray 20 is shown in the load position.

Figure 1B:
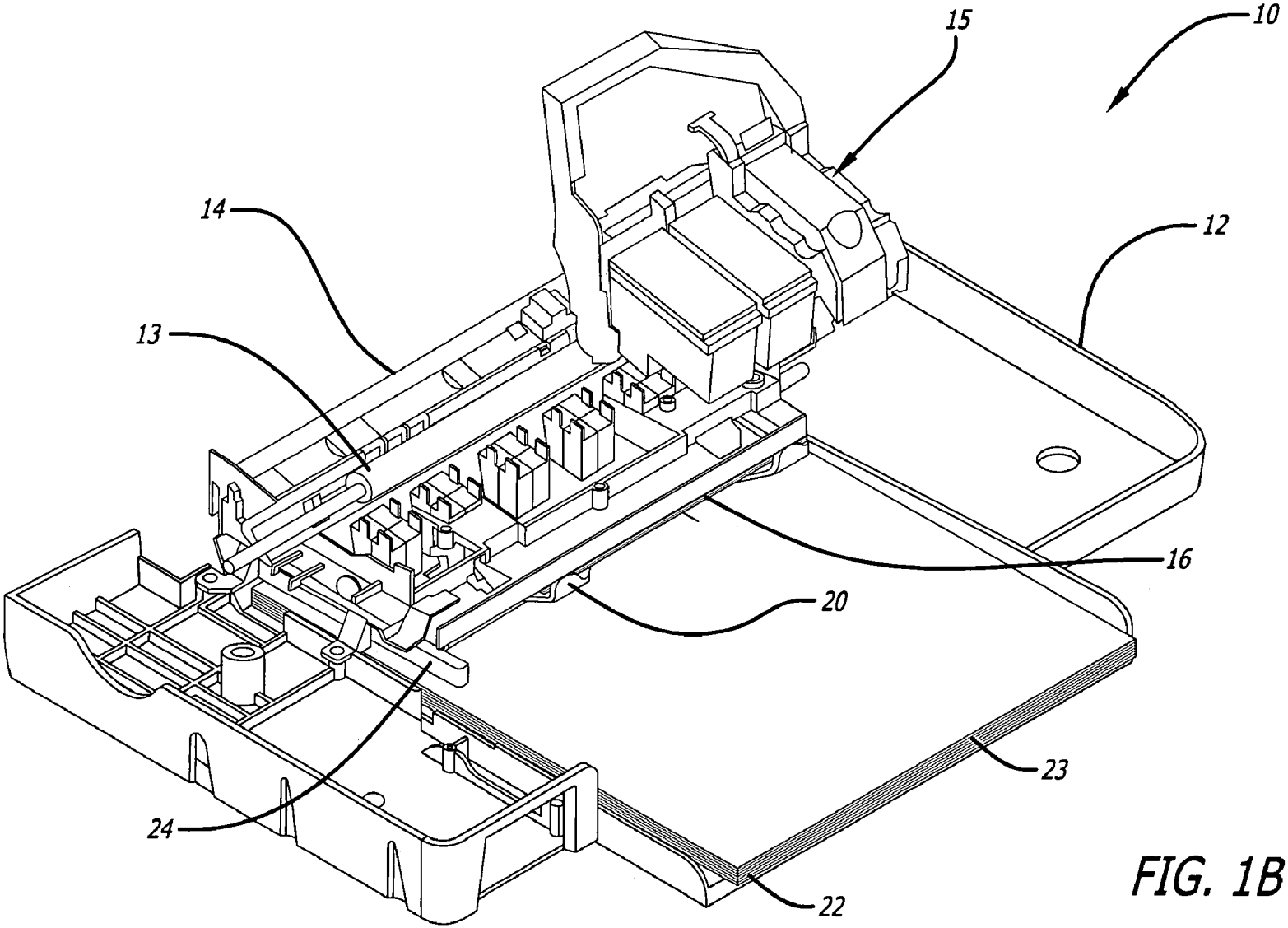
FIG. 1*b* is a perspective view of the printer of FIG. 1*a*, showing the supply tray in the pick position.

FIG. 1*b* is a perspective view of the printer 10, showing the tray 20 in the pick position. In this embodiment, when the tray 20 is in the pick position, it is completely concealed under the platen structure 14. The printer 10 may also include a second tray 22 for holding a second supply of media 23 and located where the feed mechanism can pick media from the second tray 22 when the first tray 20 is in the load position. In an illustrative embodiment, the first tray 20 is adapted to hold smaller media, such as 4×6" photo cards, while the second tray 22 is adapted to hold larger media, such as 8½×11" document sized paper. More detailed views of the media supply system 18 are shown in FIGS. 2 and 3.

Figure 2A:
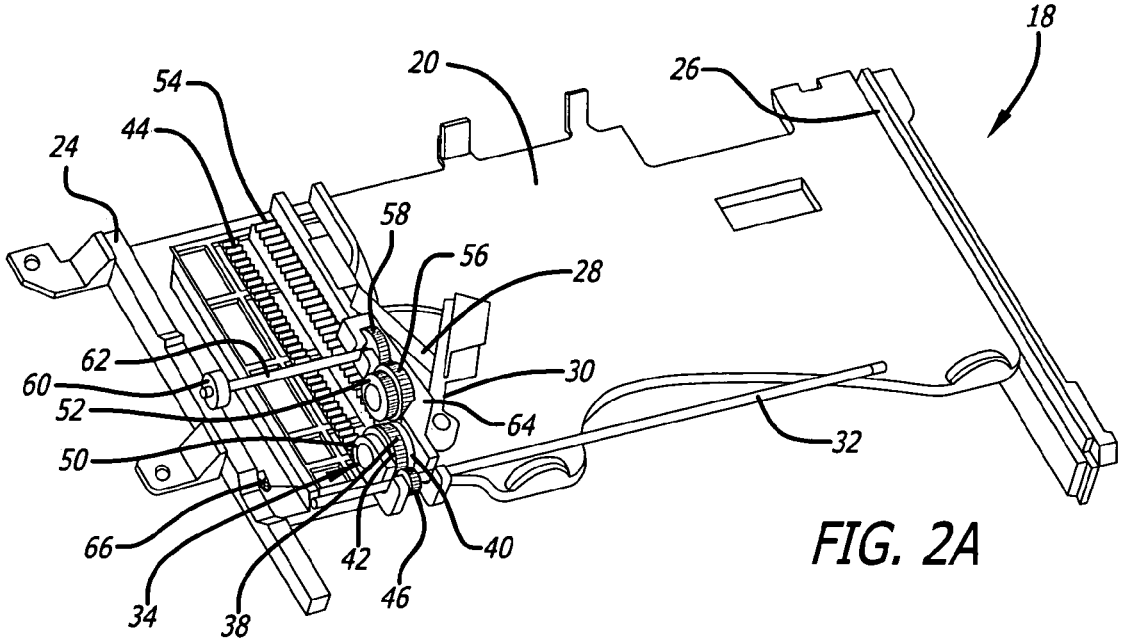
FIG. 2*a* is a perspective view of a media supply system designed in accordance with an illustrative embodiment of the present invention.

FIG. 2*a* is a perspective view of a media supply system 18 designed in accordance with an illustrative embodiment of the present invention. Two guides 24 (left) and 26 (right) support the first tray 20. Grooves embedded in the guides 24 and 26 allow the tray 20 to slide in a direction parallel to the guides between the load and pick positions. In FIG. 2*a*, the tray 20 is shown in the pick position. The guides 24 and 26 are mounted on the chassis 12 of the printer 10 (as shown in FIG.

1). The system 18 may also include a mechanism for adapting the tray 20 to hold different sized media, such as a width adjustor 30 coupled to a spring 28 for biasing the media to a wall of the tray (formed, in the illustrative embodiment of FIG. 2*a*, by the right guide 26).

The media supply system 18 also includes a novel input drive mechanism 34 for automatically moving the tray 20 from the load position to the pick position. The feed mechanism of the printer 10 typically includes a pick arm shaft 32 driven by a pick motor (not shown) that supplies rotational motion to the components of the feed mechanism. In one embodiment, the input drive mechanism 34 is coupled to the pick arm shaft 32. The pick arm shaft 32 is normally only rotated in one direction (for example, counter-clockwise). This embodiment uses the second direction of the pick arm shaft 32 (clockwise, in the example) to drive the input drive mechanism 34. When the pick arm shaft 32 is rotated in the first direction ("pick" direction), the feed mechanism picks media from the tray 20 (or the second tray 22). When the pick arm shaft 32 is rotated in the second direction ("reverse pick" direction), the tray 20 is driven from the load position to the pick position.

Figure 2B:
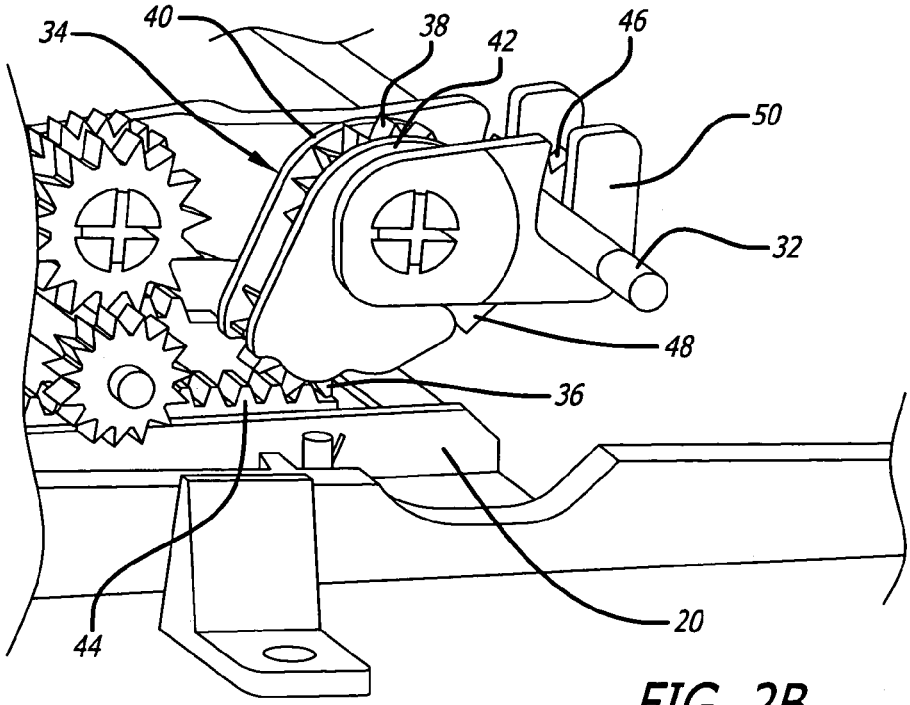
FIG. 2*b* is a perspective view of an input drive mechanism designed in accordance with an illustrative embodiment of the present invention.

When the printer 10 is instructed to print from the first supply tray 20, the pick arm shaft 32 is rotated in a reverse pick cycle until the pick motor stalls. A motor stall occurs when the tray 20 has been pulled in as far as possible, into the pick position. Then the pick arm shaft 32 cannot be rotated any further, causing a current spike in the pick motor (because the motor is forcing itself). This causes a motor stall, and the printer cuts off power to the motor. The direction of the pick shaft 32 is then reversed, and media is picked by the feed mechanism and fed to the print mechanism. The "click-to-dot" time (mechanism movement time between instructing the printer to print and when printing actually begins) is minutely affected by including the automated supply tray system 18. The complete retraction of the tray 20 (moving from the load to pick positions) and the reversal of the pick motor are almost unnoticeable. Maintaining low "click-to-dot" time may be desirable in some applications so that the inclusion of the automated supply tray system 18 does not deter printing speed conscious users. In the illustrative embodiment, the "click-to-dot" time added to the print cycle is less than 2 seconds, although this time may vary. FIG. 2*b* shows the input drive mechanism 34 in more detail.

FIG. 2*b* is a perspective view of an input drive mechanism 34 designed in accordance with an illustrative embodiment of the present invention. In the illustrative embodiment, the input drive mechanism 34 is a swing arm assembly including two gears, a small driver 36 and an arm idler 38, supported between two flat swing arm bodies, a right arm body 40 and a left arm body 42. The input drive mechanism 34 may also include a follower spring 48 for applying a normal force at the idler 38 and arm body 42 interface, and an arm clip 50 for supplying strength and stiffness to the swing arm assembly 34.

The small driver 36 is adapted to engage a rack 44 embedded in the tray 20 and pull the tray 20 in from the load position to the pick position. The rack 44 is oriented in the direction of motion, parallel to the edge guides 24 and 26.

The arm idler 38 is adapted to engage a pick shaft pinion 46 mounted on the pick shaft 32 and rotate the swing arm assembly 34. When the pick shaft 32 rotates in the pick direction (counter-clockwise in the example), the swing arm 34 is rotated (clockwise) and lifted up, disengaging the small driver 36 from the rack 44. When the pick shaft 32 rotates in the reverse pick direction (clockwise), the swing arm 34 is lowered such that the small driver 36 engages the rack 44, pulling the tray 20 into the pick position.

Since both directions of the pick shaft 32 are being used, a separate output drive mechanism 52 (FIG. 2*a*) may be used to drive the tray 20 out from the pick position to the load position, after printing has been completed. The output drive system 52 is coupled to a different drive train in the printer 10.

In the illustrative embodiment shown in FIG. 2*a*, the output drive mechanism 52 is a rack and pinion drive system. The tray 20 includes a second rack 54 embedded in the tray 20, parallel to the first rack 44. In the example, the second rack or output rack 54 is shown raised slightly higher than the first input rack 44. The output drive mechanism 52 includes a driver gear 56 (double driver gears are shown in the example of FIG. 2*a*) adapted to engage the output rack 54 and drive the tray 20 out to the load position. Motion is transmitted to the driver gear 56 by an output idler gear 58, which is coupled to a drive pinion 60 by an output shaft 62. The drive pinion 60 is coupled to a separate drive train than the input drive system 34. A gear beam 64 is provided to support the output drive system 52 and the input drive system 34.

In some embodiments, the tray 20 is driven out until the driver gear 56 loses engagement with the output rack 54. At this point, a spring loaded retention system may be used to keep the tray disengaged from the output drive system 52. In the illustrative embodiment, the spring loaded retention system includes a retention spring 66 mounted on the left guide 24, which biases the tray 20 in the full "out" or load position and assures the output rack 54 will not self-engage on the double driver gear 56. If the tray is reliably disengaged from the output drive system 52, an extension to the transmission can then be used to drive additional printer functionality such as CD printing, wherein the tray 20 supports a CD while a surface of the CD is printed upon. CD printing, in some embodiments, uses both rotational directions from the pinion gear 60 that transmits motion to the output drive transmission 52. CD printing, unlike traditional paper printing, typically uses both feed directions. Because CDs are rigid, they cannot be passed through the traditional "U" shaped paper path. If a CD is to be loaded from the front of a printer, it must be driven bi-directionally into the printer and out from the printer by the feed mechanism. The retention system 66 provides that both directions of rotations will be available for CD printing (or other printer functions) until the automated tray 20 is activated (i.e. pulled into the pick position).

While the illustrative embodiment shown has a rack and pinion output drive system, the specific configurations may vary. Other output mechanisms, such. as a biased spring, may be used to move the tray from the pick position to the load position without departing from the scope of the present teachings.

Figure 3A:
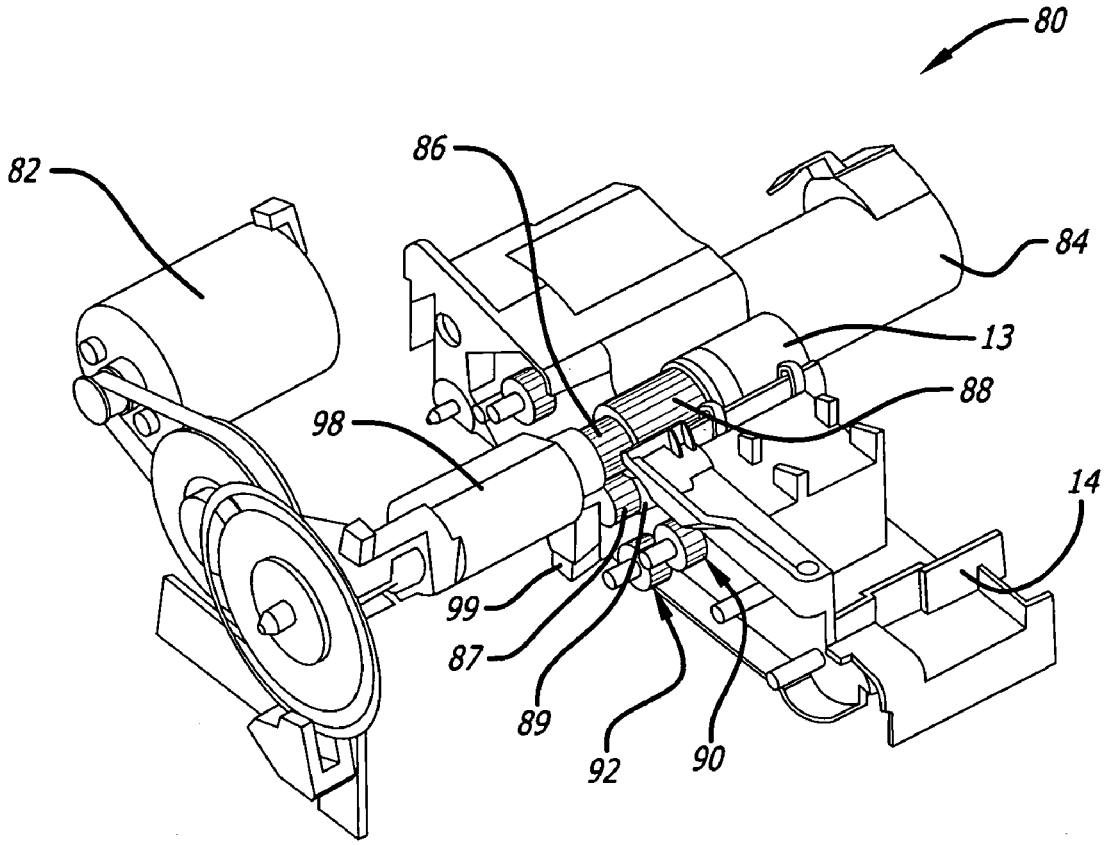
FIG. 3*a* is an isometric view of an illustrative power transmission arrangement for providing power to the media supply system of FIGS. 2*a* and 2*b*.
Figure 3B:
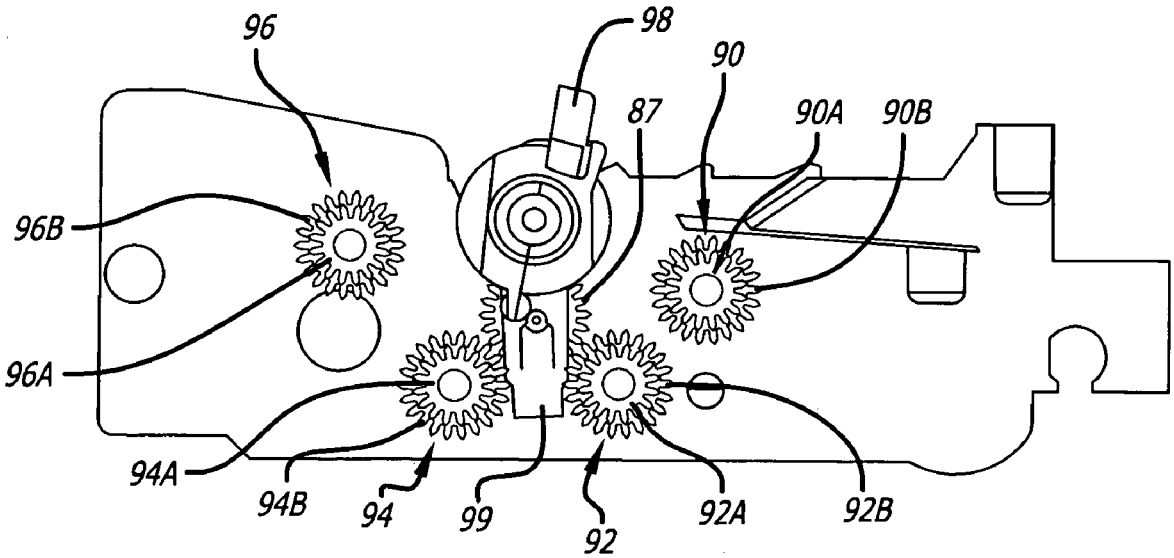
FIG. 3*b* is a side view of the illustrative power transmission arrangement for the printer of FIG. 1.

FIG. 3*a* is an isometric view of an illustrative power transmission arrangement 80 for providing power to the media supply system 18 of FIGS. 2*a* and 2*b*, and FIG. 3*b* is a side view of the illustrative power transmission arrangement 80. Other transmission arrangements may, of course, be used without departing from the scope of the present teachings. In this example, the printer 10 includes two motors 82 and 84. The first motor 82 drives a first input gear 86, causing it to rotate. Similarly, the second motor 84 drives a second input gear 88. The first input gear 86 engages a gear 87, and the second input gear 88 engages a gear 89. The gears 87 and 89 are each adapted to engage a gear in one of a plurality of gear trains 90, 92, 94, and 96, each gear train including two gears (90A and 90B, 92A and 92B, 94A and 94B, and 96A and 96B, respectively). The gear 87 is positioned to engage gear 90A, 92A, 94A, or 96A, and gear 89 is positioned to engage gear 90B, 92B, 94B, or 96B, depending on the position of a swing arm 99. Each of the gears in the gear trains is coupled to a different part of the printer. For example, gear 90A may be coupled to the pick shaft 32 (of FIG. 2*a*) and gear 92A may be coupled to the output shaft 62.

A carriage shift may be used to shift from one gear train to another. The carriage (not shown) is adapted to engage a leash 98, allowing the swing arm 99 to rotate and change position, and coupling the gears 87 and 89 to a selected gear train. In FIG. 3*b*, the swing arm 99 is shown in a "neutral" position, such that the input gears 86 and 88 are not coupled to any of the gear trains.

In this example, when a user wants to print from the automated tray 20, the power transmission system 80 is shifted from neutral to gear train 90. Motor 82 is therefore coupled to the pick shaft 32. The motor 82 is driven in a first direction, causing the pick shaft 32 to rotate in the reverse pick direction, pulling the tray 20 into the pick position (as described above). The motor 82 is then reversed, causing the pick shaft 32 to rotate in the pick direction, feeding paper into the printer. Reversing the motor 82 takes a relatively small amount of time. In contrast, when the tray 20 is to be output to the load position, the transmission system 80 is shifted from gear train 90 to gear train 92, coupling motor 82 to the output shaft 62. This shifting of gears typically takes a much longer time than reversing a motor; however, additional time after printing (unlike before printing) is usually deemed acceptable.

Figure 4:
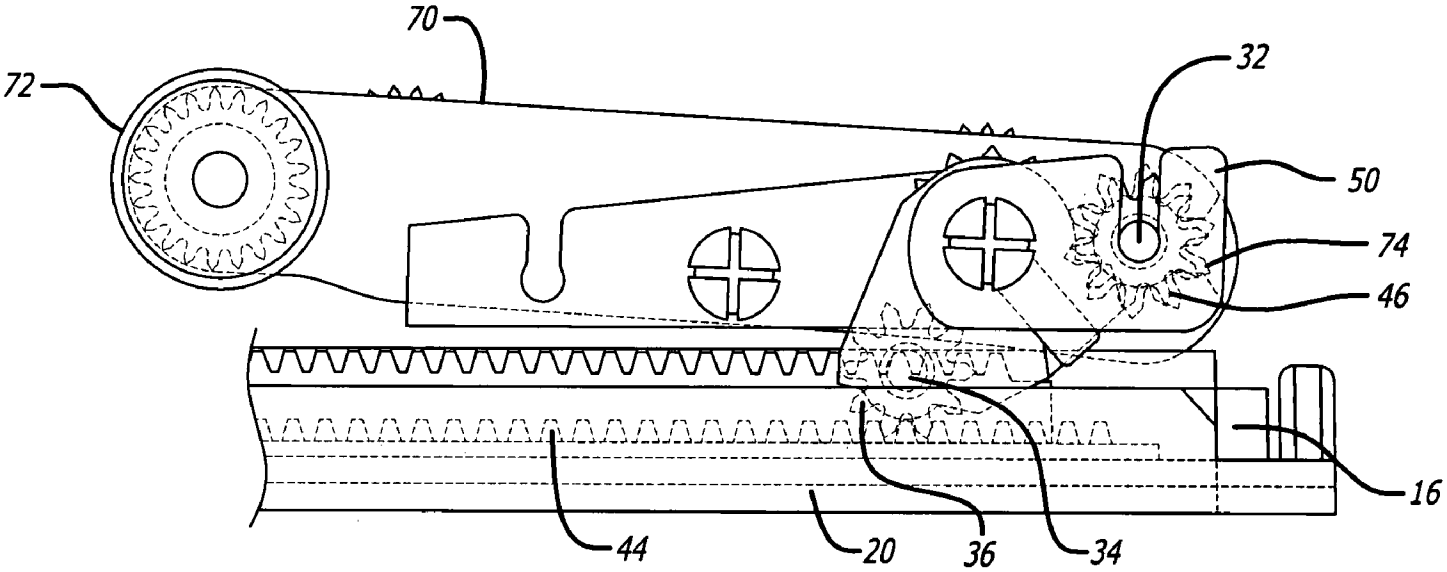
FIG. 4 is a side view showing the locations of the pick arm and the swing arm assembly during the movement of the automated input tray from the load position to the pick position in accordance with an illustrative embodiment of the present invention.
Figure 5:
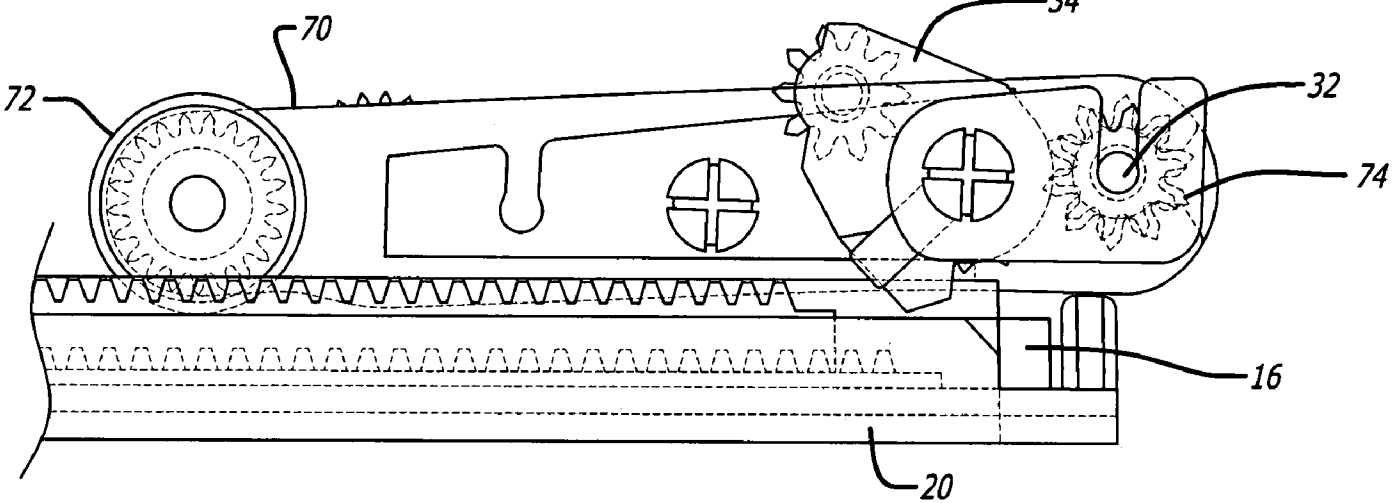
FIG. 5 is a side view showing the locations of the pick arm and the swing arm assembly during the media pick algorithm in accordance with an illustrative embodiment of the present invention.
Figure 6:
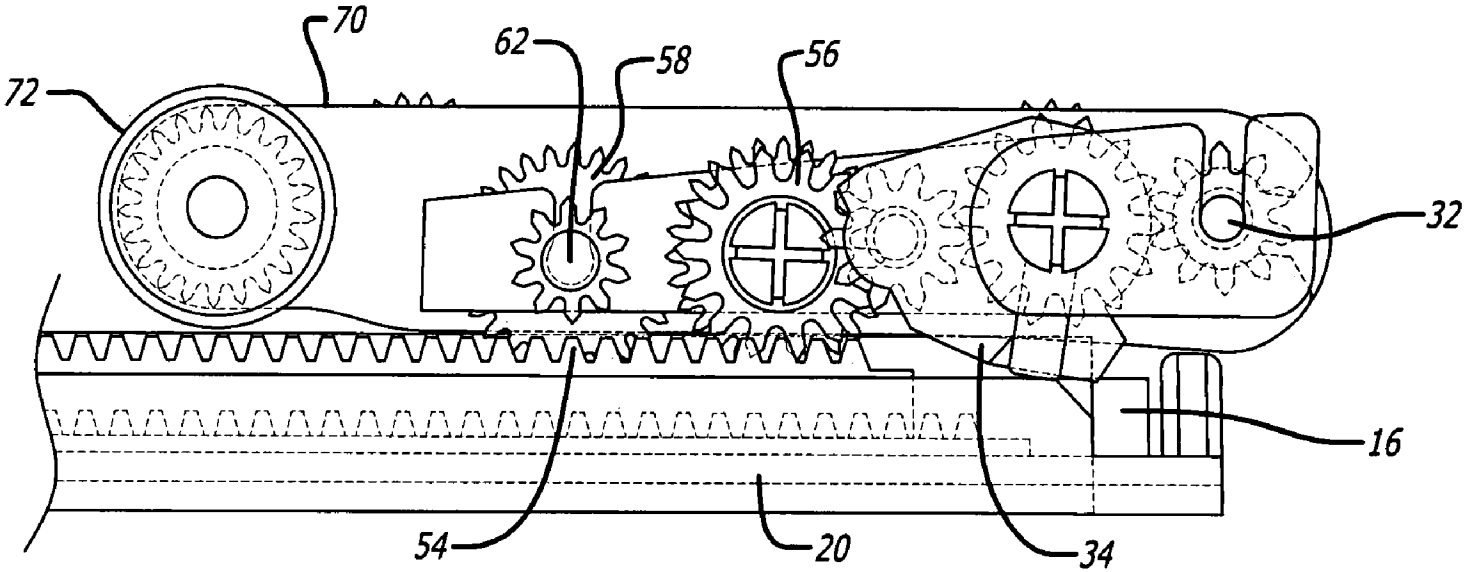
FIG. 6 is a side view showing the locations of the pick arm and the swing arm assembly during the movement of the automated input tray from the pick position to the load position in accordance with an illustrative embodiment of the present invention.

FIGS. 4-6 illustrate the operation of the input and output drive mechanisms 34 and 52. In this example, the pick direction is counter-clockwise and the reverse pick direction is clockwise. In the illustrative embodiment, the feed mechanism of the printer 10 includes a pick arm 70 coupled to the pick shaft 32. The pick arm 70 includes one or more pick and feed rollers 72 for picking media 16 from the input tray 20 and feeding it to the print mechanism of the printer 10.

FIG. 4 is a side view showing the locations of the pick arm 70 and the swing arm assembly 34 during the movement of the automated input tray 20 from the load position to the pick position. The pick arm 70 is fully lifted off the media stack 16 while the input drive swing arm 34 engages on the input rack 44 of the tray 20 and pulls the tray 20 until the pick position is reached. This position is achieved by rotating the pick arm shaft 32 in the reverse pick direction (counter-clockwise with respect to the figure). A follower spring (not shown) may be used to create friction between a driving gear 74 (mounted on the pick shaft 32, that drives the pick arm gears) and the pick arm body 70.

This friction is strong enough to generate a moment and lift the arm 70, yet light enough to allow "slip" to occur once the pick arm 70 reaches its up most position. In the example of FIG. 4, a counter-clockwise rotation of the pick shaft 32 lowers the pick arm 70, and a clockwise rotation of the pick shaft 32 raises the pick arm 70.

FIG. 5 is a side view showing the locations of the pick arm 70 and the swing arm assembly 34 during the media pick algorithm. When a stall is detected by the motor driving the tray 20 in, indicating that the tray 20 has reached the pick position, the printer 10 goes into a media pick routine. The pick arm shaft 32 rotates in the pick direction (clockwise), completely lifting the swing arm 34 off of the input rack 44 and engaging the pick and feed rollers 72 of the pick arm 70 with the media surface. The pick and feed rollers 72 feed the top sheet from the media supply 16 to the print mechanism for printing.

FIG. 6 is a side view showing the locations of the pick arm 70 and the swing arm assembly 34 during the movement of the automated input tray 20 from the pick position to the load position. After a print job is completed, the pick arm shaft 32 is rotated in the reverse pick direction a slight amount. This will lift the pick arm 70 off any remaining media 16 and rotate the swing arm 34 in the counter-clockwise direction (yet not enough to engage the input rack 44 on the tray 20). The printer 10 then shifts to the output drive transmission 52 and the double driver 56 will push the tray 20 out to the load position. Now media 16 can be reloaded, and the cycle repeated.

In one embodiment of the invention, when the tray 20 is out in the load position, the pick arm 70 can be lowered to pick media from a second media supply being held in a second input tray 22, which is located beneath the first tray 20 (as shown in FIG. 1).

Figure 7:
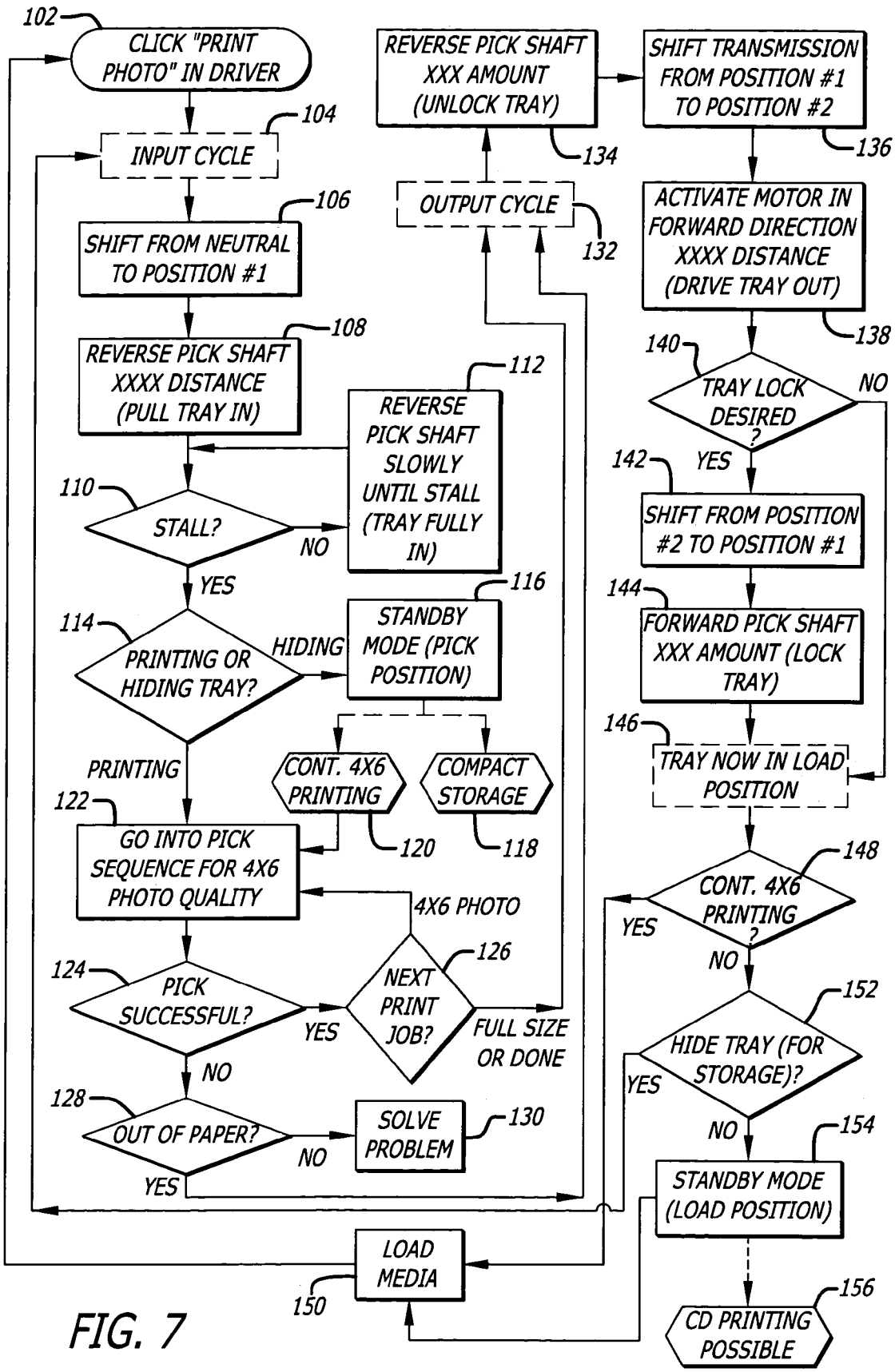
FIG. 7 is a flow diagram of the operation of the automated input tray in accordance with an illustrative embodiment of the present invention.

In an illustrative embodiment of the invention, the operation of the automated input tray 20 is controlled by software, which may comprise firmware stored on a computer-readable medium at the printer 10. FIG. 7 is a flow diagram of the operation of the automated input tray 20, according to an example embodiment. In this example, the automated tray 20 is adapted to hold 4×6" photo media, and the second input tray 22 is adapted to hold document sized paper. The sizes and types of these media may, of course, vary. In some embodiments, photo media may be employed, while in other embodiments a variety of other suitable media are employed.

A print cycle begins at Step 102 when a user clicks on "print photo" in the printer driver. This starts an input cycle 104.

An input cycle 104, according to this example embodiment, includes the following steps. At Step 106, shift the transmission from neutral to position 1 (coupling the motors 82 and 84 to the gear train 90 to drive the pick shaft 32, as shown in FIG. 3*b*). At Step 108, rotate the pick shaft 32 in the reverse pick direction for a predetermined distance, pulling the tray 20 into the pick position. At Step 110, determine whether a motor stall was detected. If no, then at Step 112, rotate the pick shaft 32 slowly in the reverse pick direction until a stall is detected, indicating that the tray 20 is fully in.

Once the tray 20 is in the pick position, at Step 114, determine whether the printer 10 is supposed to be printing or hiding the tray 20 (both of which start an input cycle). If printing, then enter the pick sequence at Step 122. If hiding, then enter a standby mode 116 with the tray 20 in the pick position. This enables compact storage 118 of the tray 20. While the automated tray 20 is in the pick position, printing using media from the second tray 22 cannot occur (the automated tray 20 must first be ejected). If printing from the first media supply (photo printing) is desired while the automated tray 20 is in the pick position, the printer 10 can then go straight to the pick sequence at Step 122.

At Step 124, determine whether media was successfully picked. If yes, at Step 126 prepare for the next print job. If the next print job is another photo (same media supply), then go to Step 122 to pick another media sheet. If the next print job is a full sized document (second media supply from the second input tray 22) or the print jobs are completed, then go to the output cycle 132.

If, at Step 124, an error occurred during the pick sequence, then determine whether the automated tray 20 is out of paper (Step 128). If yes, then go to the output cycle 132. If no, then solve the problem that occurred (Step 130).

The output cycle 132 begins at Step 134, rotating the pick shaft 32 in the reverse pick direction by a small amount to lift the pick arm 70 off of the automated tray 20. At Step 136, shift the transmission from position 1 (pick shaft 32) to position 2 (coupling the motors 82 and 84 to the gear train 92 to drive the output shaft 62, as shown in FIG. 3*b*). At Step 138, rotate the output shaft 62 by a predetermined distance to drive the tray 20 out to the load position. At Step 140, determine whether a tray lock is desired. If no, then continue to Step 146. If yes, at Step 142, shift the transmission from position 2 to position 1 and, at Step 144, rotate the pick shaft 32 in the pick direction a small amount, lowering the swing arm assembly 34 to engage and lock the tray 20. The tray 20 is now in the load position (Step 146).

At Step 148, determine if continued printing with the first media supply (photo media) is desired. If yes, at Step 150, a user can load more media into the automated tray 20. Printing can then continue at Step 102, when "print photo" is clicked in the driver. If no, at Step 152, determine whether the automated tray 20 should be hidden (for storage). If yes, then go to the input cycle 104. If no, then enter a standby mode 154 with the automated tray 20 in the load position. From this position, CD printing 156 is possible, and a user can load more media into the automated tray 20 (Step 150).

Thus, the automated tray of the present invention is a software driven media tray that automatically moves media from a load position (where media can be loaded by a user) to a pick position (where transport of the media through the printer mechanism begins). Once the tray is empty, or photo printing is finished, the driver automatically outputs the tray back into the load position. The only user interface is the physical loading of the media into the tray and then clicking "print photo" in the device driver. In some embodiments, the user should only have to touch the media and not the printer during loading.

In an illustrative embodiment, the media in the automated tray is oriented in the "landscape" direction, providing a significant increase in print speed (as compared to orientation in the "portrait" direction) and also allowing for a compact printer design with foldable trays. In addition, the driver settings can be adapted to automatically change to a desired print mode (such as optimized for 4×6" borderless photo printing) whenever the automated tray is instructed to retract once "print photo" is clicked. In one embodiment, the automated tray is dedicated to one type of media, such as 4×6" photo media. The driver settings can therefore be set to that specific size and type of media. The user would always have the correct print mode settings since, in this example, all 4×6" photo printing would occur in this tray. Dedicating a tray to 4×6" photo media would not only automate the loading of the media, but also the driver settings to support this specific media.

An automated tray designed in accordance with the teachings of the present invention could also support wireless printing of photos and normal media (as long as photo media was already loaded in the automated tray). With a supply of photo media in the automated tray, a user could wirelessly order a normal (full-size fast mode) print job and then consecutively a best mode borderless photo print with zero physical interaction.

Thus, the present invention has been described herein with reference to particular embodiments. Those having ordinary. skill in the art and access to the present teachings will recognize additional modifications, applications and embodiments within the scope thereof.

It is therefore intended by the appended claims to cover any and all such applications, modifications and embodiments within the scope of the present invention.

Accordingly,

What is claimed is:

1. A system for supplying media to a device comprising:

a motor having an output shaft;

a first tray for holding a first supply of media;

a mechanism configured to feed media from said first tray to said device using motion supplied by the motor and transmitted to the media so as to drive the media when said shaft is rotated in a first direction; and first means for moving said first tray from a first position to a second position using motion supplied by the motor and transmitted to the first tray such that the transmitted motion drives the first tray when said shaft is rotated in a second direction.

2. The invention of claim 1 wherein said first position is adapted for loading media into said first tray.

3. The system of claim 2 wherein said second position is adapted for engaging a sheet of said media held in said first tray with said mechanism.

4. The system of claim 1 wherein said first means translates the first tray from the first position to the second position.

5. The system of claim 1 wherein said system further includes second means, separate from said first means, for moving said first tray from said second position to said first position.

6. The system of claim 5 wherein said second means includes an output drive transmission.

7. The system of claim 6 wherein said first tray further includes a second rack gear oriented parallel to the direction of motion.

8. The system of claim 7 wherein said first means includes a swing arm assembly.

9. The system of claim 8 wherein said first tray includes a first rack gear.

10. The system of claim 9, wherein said first means includes a swing arm assembly and wherein the swing arm assembly includes a driver gear adapted to engage said first rack gear and move said tray from said first position to said second position.

11. The system of claim 10 wherein said swing arm assembly further includes an idler gear coupled to a pick shaft pinion mounted on said shaft for rotating said swing arm assembly such that said swing arm disengages from said first tray when said shaft is rotated in said first direction, and engages said first tray when said shaft is rotated in said second direction.

12. The system of claim 10 wherein said swing arm assembly is coupled to said shaft.

13. The system of claim 12 wherein said driver gear is adapted to engage said first rack gear and move said tray from said first position to said second position when said shaft rotates in said second direction.

14. The system of claim 12 wherein said swing arm assembly is adapted to disengage from said first rack gear when said shaft rotates in said first direction.

15. The system of claim 7 wherein said output drive transmission includes a gear adapted to engage said second rack gear and move said first tray from said second position to said first position.

16. The system of claim 6 wherein said output drive transmission is coupled to a second shaft.

17. The system of claim 16 wherein said second shaft is also adapted to drive an additional printer function.

18. The system of claim 16 wherein said second shaft is also adapted to move the tray bi-directionally to print a CD.

19. The system of claim 1 wherein said system further includes a mechanism for adapting the first tray to hold different sized media.

20. The system of claim 19 wherein said mechanism includes a width adjustor coupled to a spring for biasing the media to a wall of the first tray.

21. The system of claim 1 wherein said system further includes a second tray for holding a second supply of media.

22. The system of claim 21 wherein said second tray is located such that said mechanism can engage said second supply of media when said first tray is in said first position.

23. The system of claim 21 wherein settings for said device can be set according to which of said trays is used.

24. The system of claim 1 wherein said media in said first tray is oriented in a landscape direction.

25. The system of claim 1 wherein said first tray is completely concealed under a platen structure of said device when said first tray is in said second position.

26. The system of claim 1 wherein said device is a printer.

27. The system of claim 1, wherein the motor is stationary when the shaft is rotating in the first direction and when the shaft is rotating in the second direction.

28. The system of claim 1, wherein the mechanism includes a pick tire, wherein the pick tire is driven by the same motor that drives the first tray.

29. The system of claim 1 further comprising:

a second motor; and a transmission configured to transmit motion from the second motor to the first tray to drive the first tray from the second position to the first position.

30. A system for supplying media to a device comprising:

a mechanism including a shaft adapted to feed media to said device when said shaft is rotated in a first direction;

a first tray adapted to hold a first supply of media and to move in a direction of motion from a load position to a pick position, wherein said load position is adapted for loading media onto said first tray and said pick position is adapted to engage a sheet of said media with said mechanism and wherein said first tray includes a first rack oriented parallel to a direction of motion of said first tray; and a swing arm transmission adapted to move said first tray from said load position to said pick position when said shaft is rotated in a second direction wherein said swing arm transmission includes a driver gear adapted to engage said first rack and move said first tray from said load position to said pick position when said shaft rotates in said second direction and wherein said swing arm transmission further includes an idler gear coupled to a pick shaft opinion mounted on said shaft for rotating said swing arm such that said swing arm disengages from said first tray when said shaft is rotated in said first direction, and engages said first tray when said shaft is rotated in said second direction.

31. The system of claim 30 wherein said system further includes a second tray for holding a second supply of media.

32. The system of claim 31 wherein said second tray is located such that said mechanism can engage said second supply of media when said first tray is in said load position.

33. A transmission system for moving a media supply tray of a device having a mechanism including a shaft adapted to feed media to said device when said shaft is rotated in a first direction, said transmission system comprising:

a first mechanism for translating said tray from a first position to a second position and a second mechanism coupled to said shaft for driving said first mechanism when said shaft is rotated in a second direction.

34. The system of claim 33 wherein said tray includes a first rack oriented parallel to the direction of motion.

35. The system of claim 34 wherein said first mechanism includes a driver gear adapted to engage said first rack and move said tray from said first position to said second position when said shaft rotates in said second direction.

36. The system of claim 35 wherein said second mechanism includes an idler gear adapted to couple said driver gear to a pick shaft pinion mounted on said shaft.

37. The system of claim 36 wherein said transmission system further includes a third mechanism for supporting said driver and idler gears, said third mechanism and gears forming a swing arm assembly adapted to rotate about said idler gear.

38. The system of claim 37 wherein said third mechanism includes two flat swing arm bodies wherein said driver and idler gears are attached between said two bodies.

39. The system of claim 38 wherein said idler gear is adapted to rotate said swing arm assembly such that said swing arm disengages from said tray when said shaft is rotated in said first direction, and engages said tray when said shaft is rotated in said second direction.

40. A printer comprising:

a motor having an output shaft;

a first tray for holding a first supply of media sheets;

a first mechanism for forming an image on a media sheet;

a second mechanism configured to feed media from said first tray to said first mechanism using motion supplied by the motor and transmitted to the media so as to drive the media when said shaft is rotated in a first direction; and a third mechanism coupled to said shaft for moving said first tray from a first position to a second position using motion supplied by the motor and transmitted to the first tray such that the transmitted motion drives the first tray when said shaft is rotated in a second direction.

41. The printer of claim 40 wherein said first position is adapted for loading media into said first tray.

42. The printer of claim 41 wherein said second position is adapted for engaging a sheet of said media held in said first tray with said second mechanism.

43. The printer of claim 40 wherein said third mechanism is configured to translate the first tray.

44. The printer of claim 43 wherein said first tray includes a first rack gear.

45. The printer of claim 44 wherein said third mechanism includes a swing arm assembly having a driver gear adapted to engage said first rack and move said first tray from said first position to said second position when said shaft rotates in said second direction.

46. The printer of claim 45 wherein said swing arm assembly further includes an idler gear coupled to a pick shaft pinion mounted on said shaft for rotating said swing arm such that said swing arm disengages from said first tray when said shaft is rotated in said first direction, and engages said first tray when said shaft is rotated in said second direction.

47. The printer of claim 40 wherein said printer further includes an output drive transmission for moving said first tray from said second position to said first position.

48. The printer of claim 47 wherein said first tray further includes a second rack gear.

49. The printer of claim 48 wherein said output drive transmission includes a gear adapted to engage said second rack gear and move said first tray from said second position to said first position.

50. The printer of claim 49 wherein said gear is coupled to a second shaft.

51. The printer of claim 50 wherein said second shaft is also adapted to drive an additional printer function.

52. The printer of claim 50 wherein said second shaft is also adapted to drive a CD printing mechanism.

53. The printer of claim 40 wherein said printer further includes a second tray for holding a second supply of media sheets.

54. The printer of claim 53 wherein said second tray is located such that said second mechanism can engage said second supply of media when said first tray is in said first position.

55. The printer of claim 53 wherein said second tray is under said first tray.

56. The printer of claim 53 wherein settings for said printer can be set according to which of said trays is used.

57. The printer of claim 40 wherein said media in said first tray is oriented in a landscape direction.

58. The printer of claim 40 wherein said printer further includes a platen structure for holding said first mechanism.

59. The printer of claim 58 wherein said first tray is completely concealed under said platen structure when said first tray is in said second position.

60. The printer of claim 40, wherein the motor is stationary when the shaft is rotating in the first direction and when the shaft is rotating in the second direction.

61. The printer of claim 40, wherein the second mechanism includes a pick tire, wherein the pick tire is driven by the same motor that drives the first tray.

62. The printer of claim 40 further comprising:

a second motor; and a transmission configured to transmit motion from the second motor to the first tray to drive the first tray from the second position to the first position.

63. A printer comprising:

a print mechanism for forming an image on a media sheet;

a feed mechanism including a pick shaft adapted to feed media to said print mechanism when said pick shaft is rotated in a first direction;

a first tray for holding a first supply of media sheets, wherein said first tray includes a first rack oriented parallel to the direction of motion;

an input drive mechanism coupled to said pick shaft for moving said first tray from a load position to a pick position when said pick shaft is rotated in a second direction, wherein said load position is adapted for loading media onto said first tray and said pick position is adapted to engage a media sheet from said first supply with said feed mechanism, wherein said input drive mechanism includes a swing arm assembly, wherein said swing arm assembly includes a driver gear adapted to engage said first rack and move said first tray from said load position to said pick position when said pick shaft rotates in said second direction and an idler gear coupled to a pick shaft pinion mounted on said pick shaft for rotating said swing arm such that said swing arm disengages from said first tray when said pick shaft is rotated in said first direction, and engages said first tray when said pick shaft is rotated in said second direction; and a second tray for holding a second supply of media sheets wherein said second tray is adapted to engage a media sheet from said second supply with said feed mechanism when said first tray is in said load position.

64. The printer of claim 63 wherein said printer further includes an output drive transmission for moving said first tray from said pick position to said load position.

65. The printer of claim 63 wherein said second tray is under said first tray.

66. A method for supplying media to a media processing device comprising:

loading media into a tray in a load position;

driving the tray with a motor to translate said tray from said load position to a pick position adapted to engage a media sheet in said tray with a feed mechanism, using a shaft rotating in a first direction; and driving said feed mechanism with the motor to feed a media sheet from said tray to said media processing device using said shaft rotating in a second direction.

67. A method for supplying media to a device comprising:

loading media into a tray in a load position;

rotating a shaft in a first direction until a motor stall is detected to move said tray from said load position to a pick position; and rotating said shaft in a second direction to drive a feed mechanism to feed a media sheet to said device.

68. The method of claim 67 wherein said method further includes outputting the tray from said pick position to said load position.

69. A system for supplying media to a device comprising:

a first tray for holding a first supply of media;

a mechanism including a shaft adapted to feed media from said first tray to said media processing device when said shaft is rotated in a first direction; and first means for moving said first tray from a first position to a second position when said shaft is rotated in a second direction, wherein the first tray is completely concealed under a platen structure of the device when the first tray is in the second position.

* * * * *

UNITED STATES PATENT AND TRADEMARK OFFICE

CERTIFICATE OF CORRECTION

PATENT NO. : 7,398,969 B2
APPLICATION NO. : 10/850089
DATED : July 15, 2008
INVENTOR(S) : Luis Elenes et al.

It is certified that error appears in the above-identified patent and that said Letters Patent is hereby corrected as shown below:

In column 8, line 26, in Claim 8, delete “claim 7” and insert -- claim 1 --, therefor.

In column 9, line 45, in Claim 30, delete “opinion” and insert -- pinion --, therefor.

Signed and Sealed this

Fourteenth Day of April, 2009

John Doll

JOHN DOLL
*Acting Director of the United States Patent and Trademark Office*